United States Patent [19]

Van de Meerakker

[11] Patent Number: 4,821,407

[45] **Date of Patent: * Apr. 18, 1989**

[54] METHOD OF MANUFACTURING A DEFLECTION UNIT FOR A CATHODE RAY TUBE

[75] Inventor: Jacobus J. M. Van de Meerakker, Eindhoven, Netherlands

[73] Assignee: U.S. Philips Corporation, New York, N.Y.

[ * ] Notice: The portion of the term of this patent subsequent to Apr. 11, 2006 has been disclaimed.

[21] Appl. No.: 99,885

[22] Filed: Sep. 22, 1987

[30] Foreign Application Priority Data

Sep. 22, 1986 [NL] Netherlands ..... 8602377

[51] Int. Cl.[4] ..... H01F 41/06

[52] U.S. Cl. ..... 29/605; 242/7.03; 242/7.07; 242/118

[58] Field of Search ..... 29/605; 242/7.03, 7.07, 242/1, 118

[56] References Cited

U.S. PATENT DOCUMENTS 3,958,328 5/1976 Lee ..... 29/605

*Primary Examiner*—Carl E. Hall

*Attorney, Agent, or Firm*—F. Brice Faller

[57] ABSTRACT

A method of manufacturing an electromagnetic deflection unit for a cathode ray tube, which unit comprises a field deflection coil consisting of two parts, a line deflection coil consisting of two parts and an annular core of a magnetizable material surrounding the two coils. The two parts of the field deflection coil are wound on the inside of a funnel-shaped field coil support. A hollow, funnel-shaped line deflection coil support having an annular flange at its wide end then passed into the field coil support to such an extent that its narrow end projects form the field coil supported and subsequently the two parts of the line deflection coil are wound on the inside of the line coil support.

5 Claims, 4 Drawing Sheets

METHOD OF MANUFACTURING A DEFLECTION UNIT FOR A CATHODE RAY TUBE

BACKGROUND OF THE INVENTION

1. Field of the Invention

The invention relates to a method of manufacturing an electromagnetic deflection unit for a cathode ray tube, which unit comprises a field deflection coil consisting of two parts, a line deflection coil consisting of two parts and an annular core of a magnetizable material surrounding the two coils, the two parts of the field deflection coil being wound in a hollow funnel-shaped coil support.

2. Description of the Related Art

Such a method is known from EP No. 0 102 658 A1. (See also DE No. 2 940 931.)

Cathode ray tubes have a neck-shaped portion one end of which accommodates an electron gun and the other end of which continues into a flared, for example, trumpet or cone-shaped part contiguous to a screen. An electromagnetic deflection unit surrounds the neck-shaped portion and engages the flared part or is provided at a short distance therefrom. In the case of a colour picture tube this deflection unit must be capable of deflecting the electron beams towards the corners of the screen while maintaining convergence. This means that both the horizontal deflection field and the vertical deflection field must have a very special distribution. To realize this, in the known method, a coil support is provided which at each of its ends has an annular flange having guide grooves accurately distributed on its circumference, in which grooves the longitudinal segments of the coil turns terminate. It is then possible to control the wire distribution (and hence the field distribution).

Since in the known method the wires of the line deflection coil and those of the field deflection coil are both wound on the inside of one and the same coil support and are therefore situated close together at that area, there is a risk of ringing occurring between the line deflection coil and the field deflection coil.

Since only a limited number of grooves can be provided at the ends in the circumferences of the annular flanges, it may occur—depending on the coil design—that there are a number of grooves through which turn segments of the line deflection coil and of the field deflection coil are passed. During winding the field deflection coil turns are first positioned in these grooves and thereafter the line deflection coil turns. In addition to the risk of ringing there is also the risk of breakdown between the line deflection coil and the field deflection coil.

SUMMARY OF THE INVENTION

It is an object of the invention to provide a winding method by which the risk of ringing or the risk of breakdown between line and field deflection coils is reduced.

In a method of the type described in the opening paragraph, according to the invention this object is realized in that after the field deflection coil parts are wound on the outside of a field coil support, a hollow, funnel-shaped line deflection coil support provided with an annular flange at its wide end is passed into the field deflection coil support to such an extent that its narrow end projects outside the field deflection coil support the two pairs of the line deflection coil are subsequently wound on the inside of the line deflection coil support.

The method according to the invention enables winding the line and field deflection coils completely separately from each other while using a minimum number of components (for example 3) so that ringing is reduced.

A deflection unit which is also of the so-called yoke winding type and which comprises field and line deflection coils wound in different supports is known per se from the Japanese Patent Application JP No. 59-20955 laid open to public inspection. However, the method described in that application is much more cumbersome and requires a larger number of components. In that method each line deflection coil part is wound on a half (saddle-shaped) support and each field deflection coil part is wound on a half (saddle-shaped) support. The four half supports are subsequently assembled into one deflection unit by means of two annular core halves.

It is possible within the scope of the invention to secure an annular flange having radial wire guide grooves to the narrow end of the line deflection coil support after it has been passed through the field deflection coil support. This, however, involves the use of an additional component and an additional assembly step. In a preferred embodiment of the method according to the invention this additional component and this additional assembly step can be dispensed with if a hollow, funnel-shaped line deflection coil support is used which is provided, with longitudinal grooves at its narrow end. During winding of each wire of the line deflection coil parts the wire is passed on the inside of the line deflection coil support through a longitudinal groove, therein, then in the circumferential direction on the outer surface of the line deflection coil support then drawn inwards through another longitudinal groove therein located at a predetermined angular distance from the first groove then passed back on the inside of the line deflection coil support. The line deflection coil parts which are the result of this method are of the incomplete saddle type.

In the two methods mentioned hereinbefore a field deflection coil support may be used which is provided with an annular flange having radial wire guide grooves both at its front end and at its narrow end. The field deflection coil parts are then of the complete saddle type. When using particularly the second of the aforementioned methods, the number of components can be still further limited when field deflection coil parts of the incomplete saddle type are wound. (The annular flange with radial wire guide grooves for the field deflection coil turns at the narrow end can then be dispensed with.) A further preferred embodiment of the method according to the invention is therefore characterized in that a hollow, funnel-shaped field coil support is used which is provided with longitudinal grooves at its narrow end and in that during winding of each wire of the field deflection coil parts the wire is passed on the inside of the field coil support through a longitudinal groove therein, then in the circumferential direction on the outer surface of the field coil support, then drawn inwards through another longitudinal groove therein located at a predetermined angular distance from the first groove then passed back on the inside of the coil support.

In the latter method the wire portion on the outer surfaces of the field coil support and the line coil support are preferably separated from each other by an annular spacer.

It is to be noted that if the field deflection coils are of the incomplete saddle type, only one (complicated) component less is required during winding but that the resulting deflection unit is not optimum from an electronoptical point of view in all cases.

An additional advantage of the method according to the invention is that the field deflection coil support and the line deflection coil support can be secured together in a simple manner, that is to say, by snap-connection. Further advantages are:

a. Since the line and field deflection coils are separated by a separate insulator (the line deflection coil support), the method according to the invention also has the advantage that the insulation of the wire to be used can be dimensioned for a lower voltage.

b. Since the line and field deflection coils are wound on separate coil supports, the filling degree of the wire guide grooves can be optimum.

The field deflection coil support which is used in the method according to the invention may be a synthetic material body having synthetic material flanges in which or around which a yoke ring of a soft magnetic material is provided. On the other hand a yoke ring itself may be the support and may be connected to a synthetic material flange at its narrow and its wide ends. Both sets of deflection coils may be either of the complete or incomplete saddle type, or one set may be of the complete saddle type and one set may be of the incomplete saddle type.

BRIEF DESCRIPTION OF THE DRAWINGS

An embodiment of a deflection unit according to the invention is shown in the drawings in which.

DESCRIPTION OF THE PREFERRED EMBODIMENTS

Figure 1:
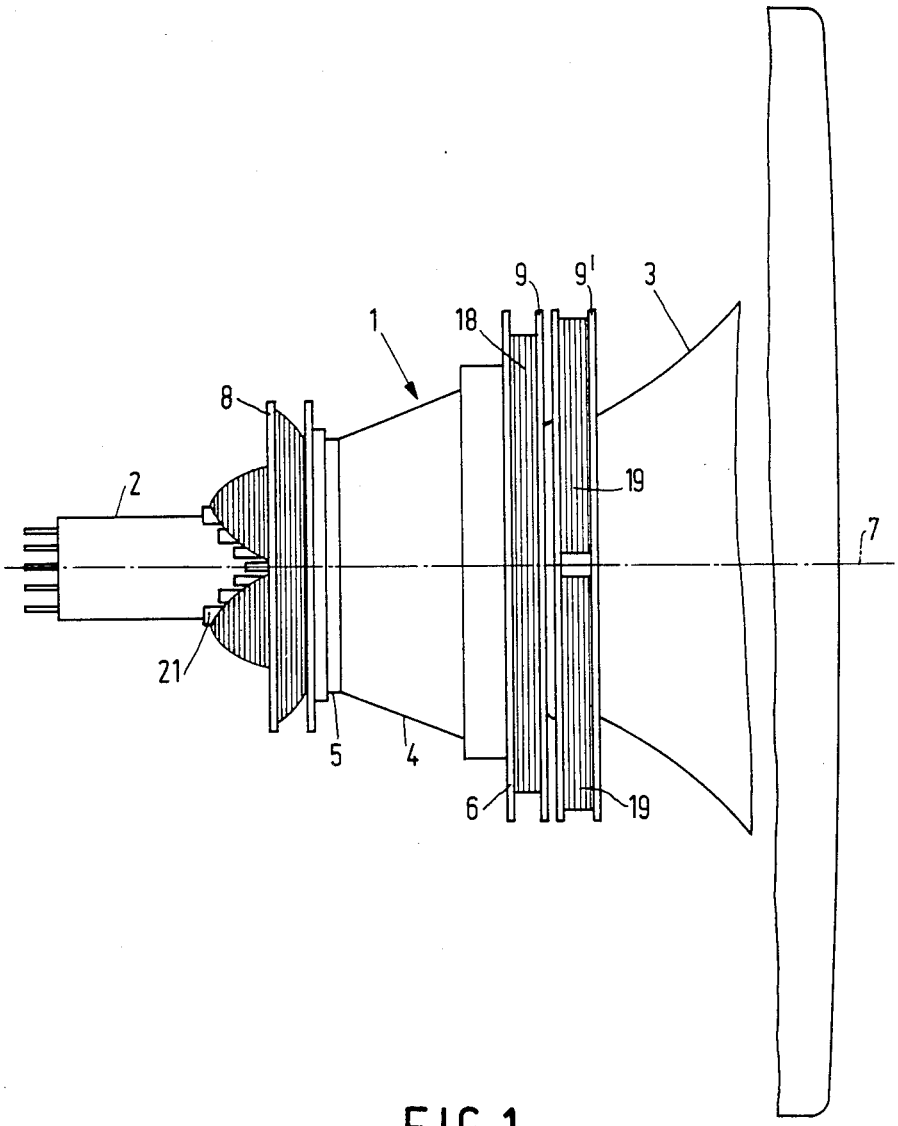
FIG. 1 is a deflection unit manufactured by the method according to the invention in a side elevational view and positioned around the neck-shaped portion of a cathode ray tube.
Figure 2:
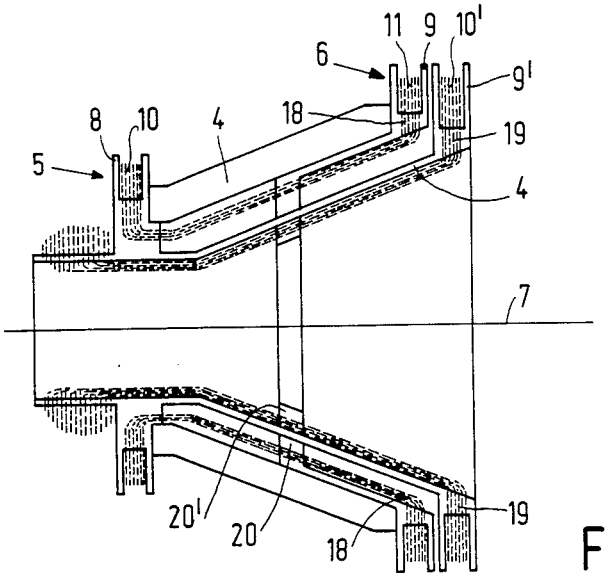
FIG. 2 is a diagrammatic longitudinal section through the deflection unit of FIG. 1.

In FIG. 1 an electromagnetic deflection unit 1 is placed around the neck-shaped portion 2 of a cathode ray tube, the flared part of which is denoted by 3. The deflection unit 1 has a hollow, funnel-shaped support 4 with a narrow end 5 and a wide end 6 and a longitudinal axis 7. In the Figure the support 4 is a yoke ring of a soft magnetic material. The support 4 has flanges 8 and 9 of translucent polycarbonate on the narrow and wide ends 5 and 6, respectively. As seen in FIG. 2, the flanges 8, 9 each have at least one tangential groove 10, 11 with a bottom and a multitude of substantially radial grooves 14 terminating in the tangential grooves 10, 11.

A first set of deflection coils 18 for the field deflection of an electron beam in a first direction at right angles to the longitudinal axis 7 (that is to say: in the plane of the drawing) is directly wound on the inside of the support 4. The turns of the set of coils 18 each pass through the tangential grooves 10 and 11 of the flanges 8 and 9, respectively, and through radial grooves 14 thereof. The deflection coils 18 are of the complete saddle type.

A second set of deflection coils 19 for the line deflection of an electron beam in a direction at right angles to the longitudinal axis 7 and at right angles to the first direction (that is to say: at right angles to the plane of the drawing) is wound on a support 4' passed into the wound support 4. In the Figure the deflection coils 19 are of the incomplete saddle type. However, the invention is not limited thereto. The second set of deflection coils 19 is also wound on the inside of its support 4' and its turns also pass through a tangential groove 10' in a flange 9' at the wide end thereof. The first set of deflection coils 18 is wound first, whilst an intermediate ring 20 (FIG. 2) may be present with grooves for guiding its turns. In an analogous manner the support 4' may be provided with an intermediate ring 20' in order to guide the turns of the set of line deflection coils 19. The deflection unit of FIG. 1 has the characteristics of a deflection unit which is manufactured by means of the method according to the invention. These characteristics are clarified in FIG. 2 and FIGS. 4 to 7. Components shown in FIG. 1 have the same reference numerals in these Figures.

In the method according to the invention the following components are used:

A yoke ring 4 of ferrite with the neck face, profile and cup-face (FIG. 4) being ground. Two extra grinding operations complete the method:

1. a very accurate outer diameter on the cup side 6 concentric with the inner profile,
2. a very accurate inner diameter on the neck side 5 concentric with the inner profile.

Two synthetic material milled rings 8 and 9 for the field deflection coil which are secured to the yoke ring 4 by means of a press fit.

The field deflection coils are of the complete saddle type. The front ring 9 is connected to an intermediate ring 20 (see FIG. 2). The field deflection coils 18 are wound with RO87-posyn grade II wire: 208 turns, 2-wire, core diameter: 0.315 mm. The winding direction is conventional, i.e. the two field deflection coils can be simultaneously wound on a machine. A number of further provisions may be provided on the cup ring 9:

1. Accurately positioned pins (for example 3) which serve as a uniform reference system for various operations and measurements on the deflection unit.
2. Recesses (for example 8) accommodating the lead-outs of the coils.

Figure 5:
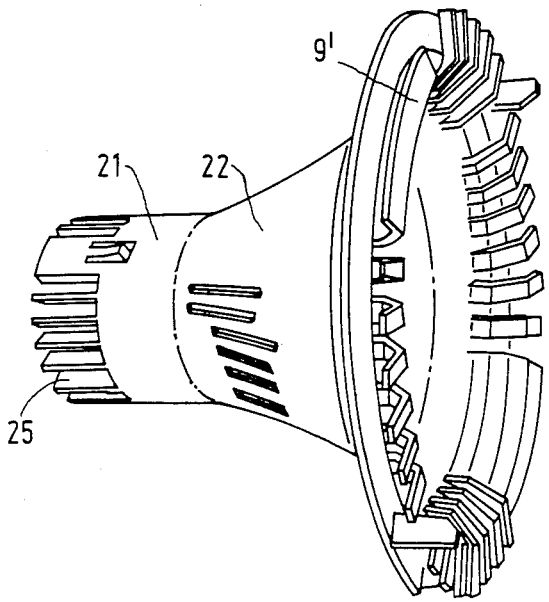
FIG. 5 shows a support for a line deflection coil
Figure 6:
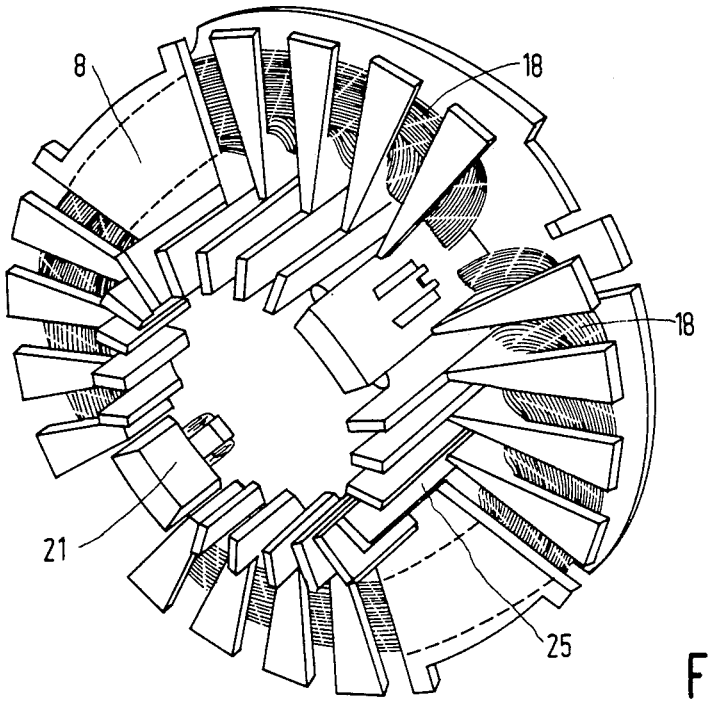
FIG. 6 shows a rear side of a wound field deflection coil support with a line deflection coil support passed into it and FIG. 7 shows the construction of FIG. 6 after a line deflection coil has been wound on it.
Figure 7:
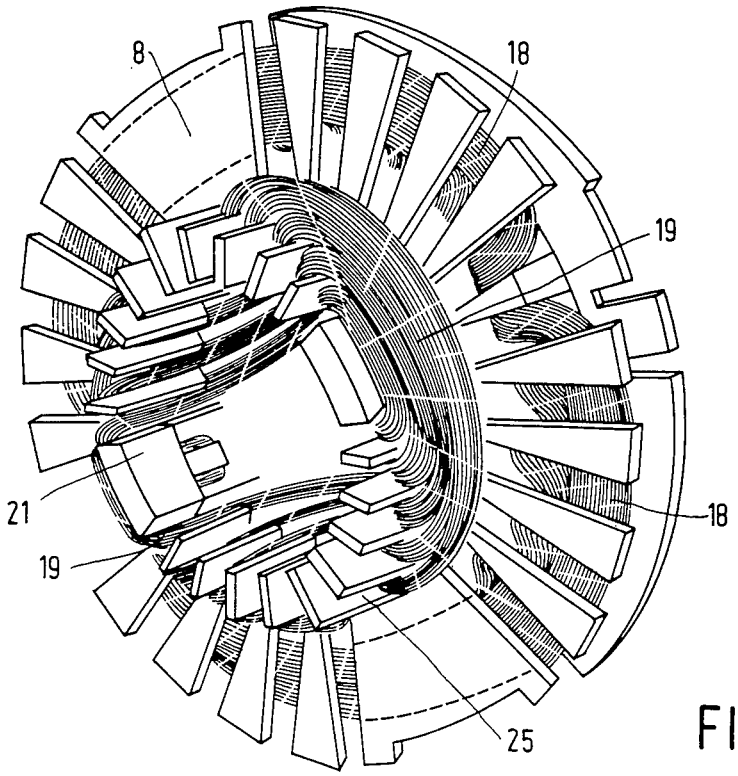

A milled synthetic material support for the line deflection coils to prevent or reduce problems of breakdown and ringing (FIG. 5).

The line deflection coils are of the incomplete saddle type. This support consists of a cup ring 9', spacer 20', neck segment 21 and separation cover 22. The line deflection coils 19 are wound with RO87-posyn grade II wire: 69 turns, 4-wire, core diameter: 0.335 mm. The winding directions of the line deflection coils are opposite to each other, also to reduce the ringing problem. The result is that the two line deflection coils cannot be wound simultaneously but must be wound one after the other. The line deflection coil support in the construction in which the field deflection coils 18 are wound can be secured as follows: by means of a key and key groove on the neck side, an abutment on the front (or screen) side and a snap connection on the neck for blocking in the Z-direction. On the cup side of the line deflection coil support provisions may be made for securing field magnets by means of a uniform snap connection, and furthermore 4 recesses accommodating the coil lead-outs.

After the field deflection coils 18 of the complete saddle type are wound on the yoke ring 4 provided with guide rings 8 (on the neck side) and 9 (on the front side), the line deflection coil--support of FIG. 5 is moved inwards to such an extent that the neck segment 21 provided with radial partitions 25 for forming longitudinal grooves projects outside the neck ring 8. See FIG. 6. Subsequently the line deflection coils 19 which are of the incomplete saddle type are wound. See FIG. 7.

Figure 3:
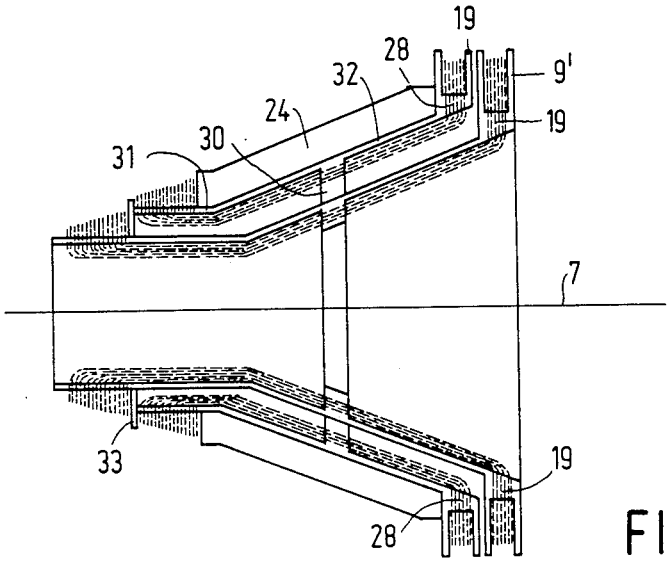
FIG. 3 is a diagrammatic longitudinal section through an alternative deflection unit also made by means of the method according to the invention.
Figure 4:
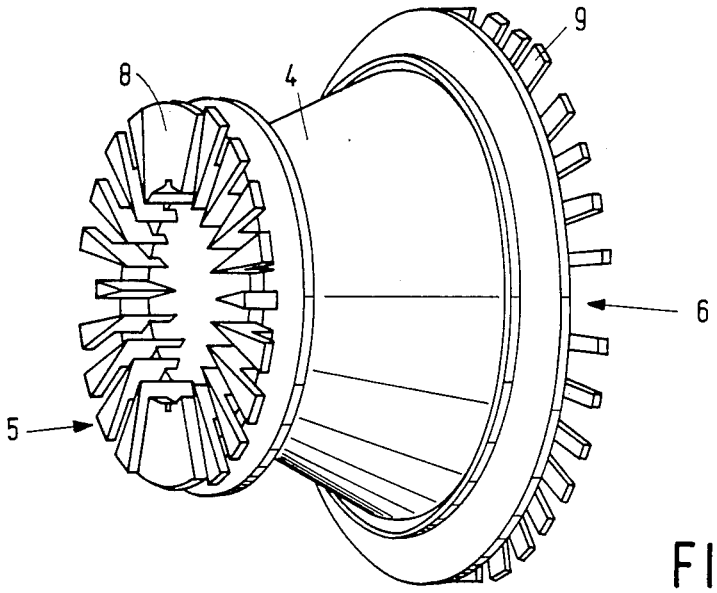
FIG. 4 shows a support for a field deflection coil.

An alternative method is described with reference to FIG. 3 in which the cup ring 8 of the field deflection coil support can be omitted. In that case a field deflection coil support consisting of a front ring 29, an intermediate ring 30, a neck segment 31 and a funnel-shaped connection part 32 is secured to the yoke ring 24 of ferrite. Field deflection coils 28 of the incomplete saddle type are wound in this field deflection coil support. Neck segment 31 has therefore a similar construction with radial partitions as the neck segment 21 of the line deflection coil support (see FIG. 5). After winding the field deflection coils 28 a synthetic material ring 33 may be secured from the free end of the neck segment 31.

What is claimed is:

1. A method of manufacturing an electromagnetic deflection unit for a cathode ray tube, which unit comprises a field deflection coil consisting of two parts, a line deflection coil consisting of two parts and an annular core of a magnetizable material surrounding the two coils; such method comprising: winding the two parts of the field deflection coil on the inside of a hollow, funnel-shaped field coil support; passing a hollow, funnel-shaped line coil support having an annular flange at its wide end into the field coil support to such an extent that its narrow end projects outside the field coil support; and subsequently winding the two parts of the line deflection coil on the inside of the line coil support.

2. A method as claimed in claim 1, characterized in that the line coil support has longitudinal grooves at its narrow end and in that each of the line deflection coil parts is wound by passing each wire thereof along the inside of the line coil support through a first longitudinal groove therein, then in the circumferential direction on the outer surface of the line coil support, then inwards through a second longitudinal groove in the line coil support located a predetermined angular distance from said first groove therein, then back on the inside of the line coil support.

3. A method as claimed in claim 1, characterized in that the field coil support has longitudinal grooves at its narrow end and in that each of the field deflection coil parts is wound by passing each wire thereof along the inside of the field coil support through a first longitudinal groove therein, then in the circumferential direction on the outer surface of the field coil support, then inwards through a second longitudinal groove in the field coil support located a predetermined angular distance from said first groove therein, then back on the inside of the field coil support.

4. A method as claimed in claim 1, further characterized in that the field coil support and the line coil support are secured by snap-connecting them together.

5. A method as claimed in claim 2, characterized in that the field coil support has longitudinal grooves at its narrow end and in that each of each of the field deflection coil parts is wound by passing each wire thereof along the inside of the field coil support through a first longitudinal groove therein, then in the circumferential direction on the outer surface of the field coil support, then inwards through a second longitudinal groove in the field coil support located at predetermined angular distance from said first groove therein, then back on the inside of the field coil support.

* * * * *